US008006317B2

(12) United States Patent
Taylor et al.

(10) Patent No.: US 8,006,317 B2
(45) Date of Patent: Aug. 30, 2011

(54) SUBMARINE ESCAPE SUITS

(75) Inventors: Richard C. Taylor, Ruthin (GB); Steve Littler, Moreton (GB); Robert J Prendergast, Bootle (GB)

(73) Assignee: Survitec Group Limited (GB)

( * ) Notice: Subject to any disclaimer, the term of this patent is extended or adjusted under 35 U.S.C. 154(b) by 0 days.

(21) Appl. No.: 12/442,370

(22) PCT Filed: Sep. 11, 2007

(86) PCT No.: PCT/GB2007/003450

§ 371 (c)(1),
(2), (4) Date: Mar. 20, 2009

(87) PCT Pub. No.: WO2008/035039

PCT Pub. Date: Mar. 27, 2008

(65) Prior Publication Data

US 2009/0313747 A1 Dec. 24, 2009

(30) Foreign Application Priority Data

Sep. 21, 2006 (GB) ..... 0618632.4

(51) Int. Cl.
*B63C 11/12* (2006.01)
*B63C 11/04* (2006.01)
*B63C 11/00* (2006.01)

(52) U.S. Cl. ..... 2/2.16; 2/2.15; 2/2.17

(58) Field of Classification Search ..... 2/2.11–2.17
See application file for complete search history.

(56) References Cited

U.S. PATENT DOCUMENTS

| | | | | | |
|---|---|---|---|---|---|
| 1,878,434 | A | | 9/1932 | Belloni | |
| 2,383,261 | A | * | 8/1945 | Kronhaus | 2/2.17 |
| 2,911,649 | A | * | 11/1959 | Ruelle et al | 2/69.5 |
| 3,107,373 | A | | 10/1963 | Mellon, Jr. et al. | |
| 3,391,405 | A | * | 7/1968 | Wiswell, Jr. | 2/2.17 |
| 3,444,570 | A | * | 5/1969 | Smith | 441/104 |
| 3,902,327 | A | | 9/1975 | Guillerm | |
| 3,925,839 | A | * | 12/1975 | Smith | 441/104 |
| 3,969,903 | A | | 7/1976 | Boisrayon | |
| 4,136,402 | A | * | 1/1979 | Insulan et al. | 2/2.15 |
| 4,227,262 | A | * | 10/1980 | Insulan et al. | 2/2.16 |
| 4,294,242 | A | * | 10/1981 | Cowans | 128/201.13 |
| 4,599,075 | A | * | 7/1986 | Nygard | 441/103 |
| 4,734,072 | A | | 3/1988 | Lastnik | |
| 4,773,101 | A | | 9/1988 | Kapp et al. | |
| 5,067,921 | A | * | 11/1991 | Bramham | 441/102 |

(Continued)

FOREIGN PATENT DOCUMENTS

DE 20308642 7/2004

(Continued)

OTHER PUBLICATIONS

U.S. Appl. No. 12/442,352, filed Apr. 28, 2009, Taylor.

(Continued)

*Primary Examiner* — Bobby H Muromoto, Jr.
(74) *Attorney, Agent, or Firm* — Workman Nydegger

(57) ABSTRACT

The submarine escape suit has a hood (14) covering the head of a wearer during ascent from a submarine. In order to allow the wearer to expose his/her face, the hood (14) is provided with a portion (21) overlying the face of a wearer that is releasable from the remainder of the hood (14). The releasable portion (21) may be re-attachable.

17 Claims, 4 Drawing Sheets

U.S. PATENT DOCUMENTS

Figure 1:
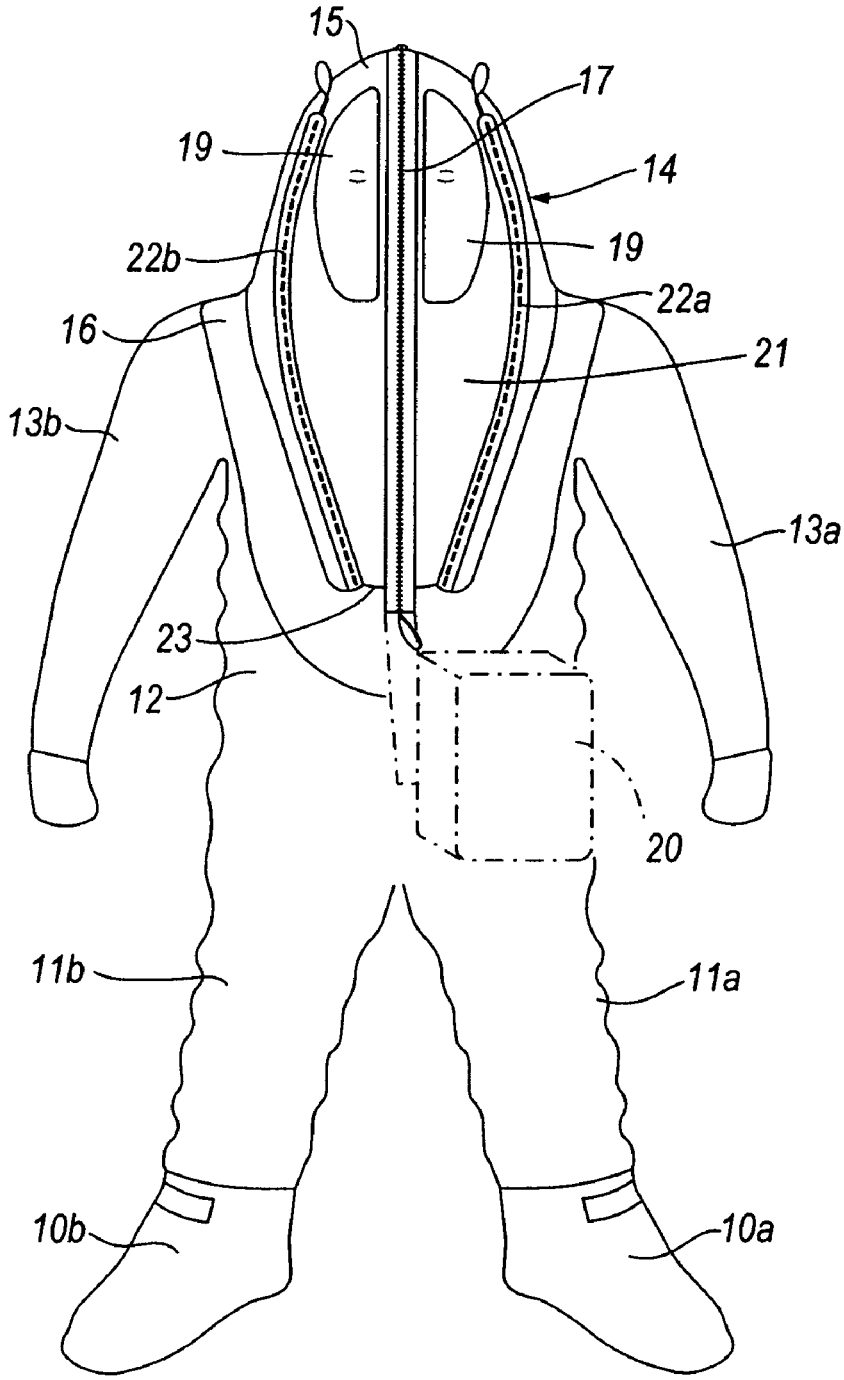

| | | | | |
|---|---|---|---|---|
| 5,127,896 | A | 7/1992 | De Gaston | |
| 5,324,219 | A | 6/1994 | Beltrani et al. | |
| 5,367,709 | A | 11/1994 | Teasley | |
| 6,357,048 | B2 * | 3/2002 | Griffiths | 2/2.17 |
| 6,659,689 | B1 * | 12/2003 | Courtney et al. | 405/186 |
| 6,860,775 | B2 | 3/2005 | Buzzetti | |
| 6,976,894 | B1 | 12/2005 | Turner | |
| 7,900,573 | B2 | 3/2011 | Prendergast | |
| 2001/0008027 | A1 * | 7/2001 | Duplock | 2/69 |
| 2001/0047530 | A1 * | 12/2001 | Griffiths | 2/2.17 |
| 2003/0024028 | A1 * | 2/2003 | Sleesen | 2/2.17 |
| 2004/0031090 | A1 * | 2/2004 | Duncan | 2/458 |
| 2004/0033739 | A1 * | 2/2004 | Courtney | 441/88 |
| 2004/0237178 | A1 * | 12/2004 | Landeros | 2/457 |
| 2007/0151593 | A1 * | 7/2007 | Jaynes | 136/244 |
| 2009/0139440 | A1 | 6/2009 | Prendergast et al. | |
| 2009/0301377 | A1 | 12/2009 | Taylor et al. | |
| 2009/0313747 | A1 | 12/2009 | Taylor et al. | |

FOREIGN PATENT DOCUMENTS

| | | |
|---|---|---|
| EP | 0444400 | 9/1991 |
| EP | 0992423 | 4/2000 |
| EP | 1352577 | 10/2003 |
| FR | 2282365 | 3/1976 |
| FR | 2823954 | 10/2002 |
| GB | 486479 | 4/1937 |
| GB | 2069416 | 8/1981 |
| GB | 2330517 | 4/1999 |
| GB | 2342277 | 4/2000 |
| GB | 2358341 | 7/2001 |
| GB | 2438606 | 12/2007 |
| JP | 2001303315 | 10/2001 |
| JP | 2004052119 | 2/2004 |
| JP | 2004143648 | 5/2004 |
| WO | 8403266 | 8/1984 |

OTHER PUBLICATIONS

U.S. Appl. No. 12/442,352, Mail Date Dec. 9, 2010, Office Action.

* cited by examiner

SUBMARINE ESCAPE SUITS

The invention relates to submarine escape suits.

A submarine escape suit is used by submariners to escape from a submarine under water. The suit is formed from a waterproof flexible material and is provided with foot and leg portions for receiving the legs and feet of a wearer, a body portion for covering the body of the wearer and arm portions for covering the arms of a wearer. In addition, a hood is provided that fits over the head of a wearer. The hood is usually provided with translucent panels so that the wearer can see out of the suit.

In use, the wearer dons the suit and enters the escape chamber of a submarine. In the escape chamber, the suit is connected an air supply system of the submarine and air collects in the suit including the hood. At the same time, the escape chamber fills with water, a hatch opens and the wearer ascends to the surface breathing the air within the hood. When the wearer reaches the surface, the wearer waits to be rescued. It is known from EP0444400 to provide the submarine escape suit with a liferaft that can be deployed after ascent to accommodate the wearer until rescue.

It is a problem with such suits that prolonged wearing of the suit on the surface can induce a feeling of claustrophobia and nausea. Some wearers would prefer to be able to remove the hood so that the head of the wearer is in the open air. This is not possible because the hood is connected to the remainder of the suit.

According to the invention, there is provided a submarine escape suit comprising a hood for covering the head of a wearer, the hood including a portion for overlying the face of a wearer, the portion being releasable from the remainder of the hood to expose the face of a wearer.

In this way, a wearer has the option of opening the hood to allow the wearer's face to be in the open air.

It can also be a problem, however, that in worsening sea conditions, water may start to splash onto the wearer's face. According to a preferred embodiment of the invention, the face portion may be re-attachable to the remainder of the hood.

The following is a more detailed description of some embodiments of the invention, by way of example, reference being made to the accompanying drawings in which:—

Figure 2:
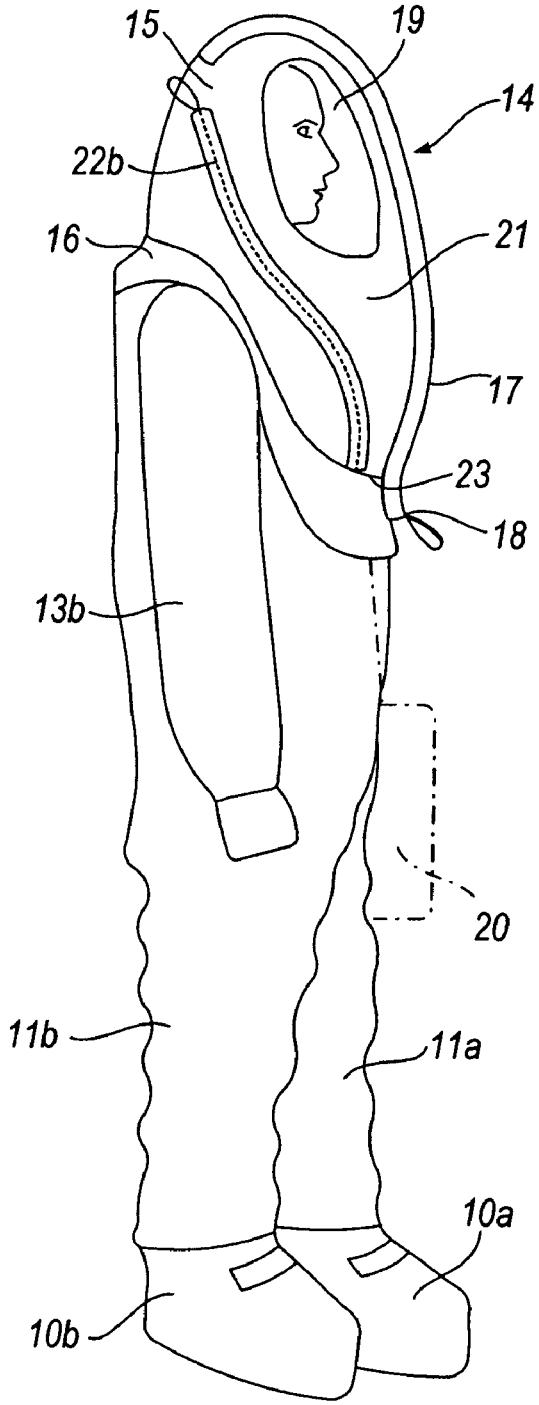
Figure 3:
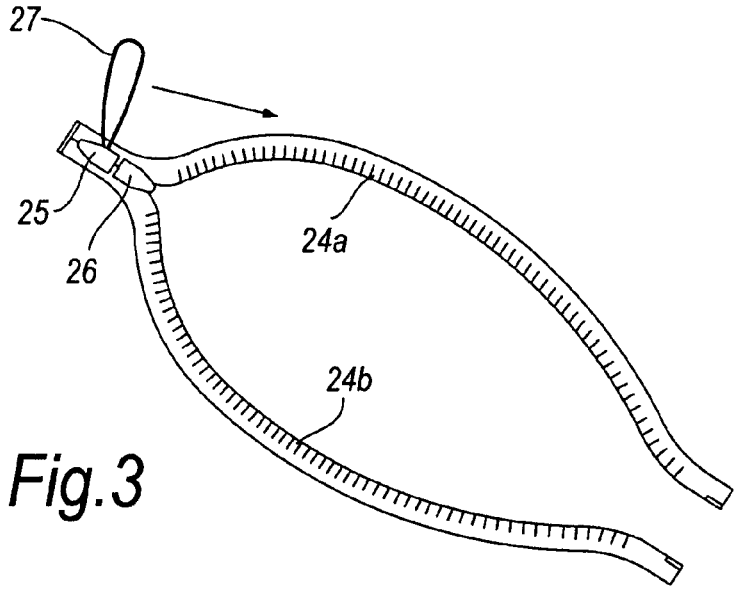
Figure 4:
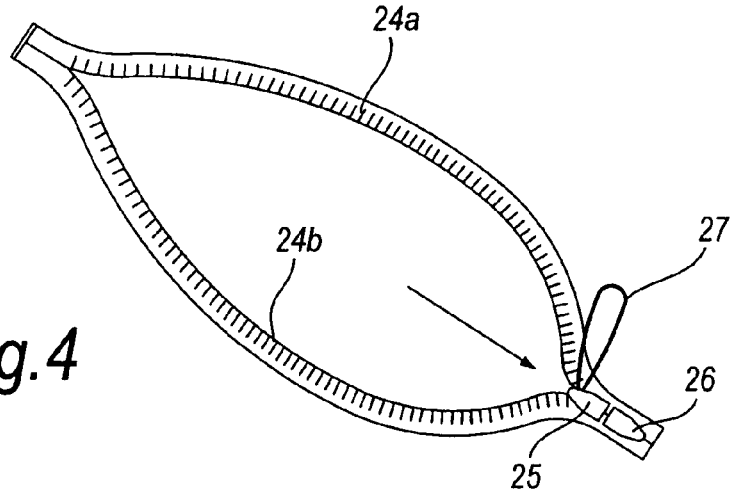
Figure 5:
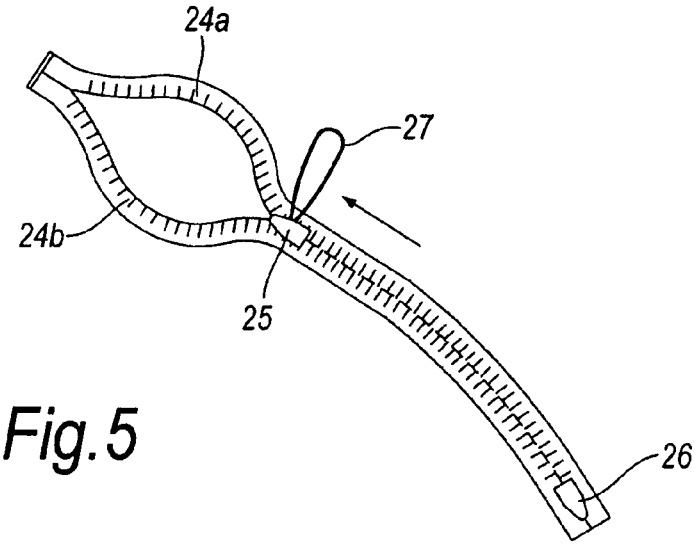
Figure 6:
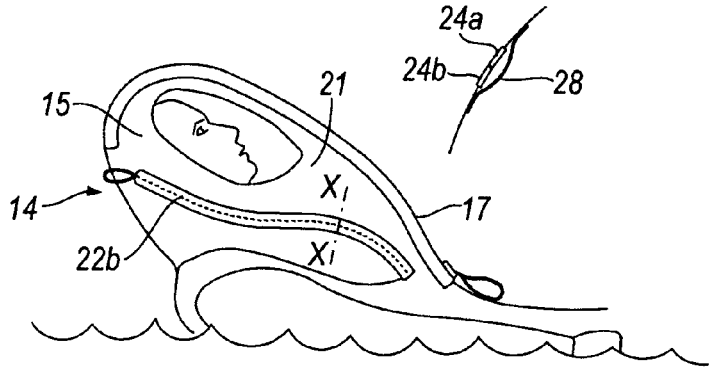
Figure 7:
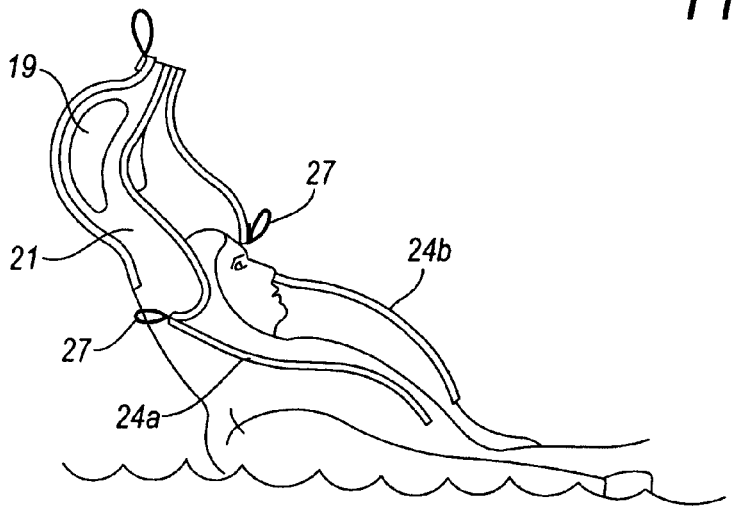
Figure 8:
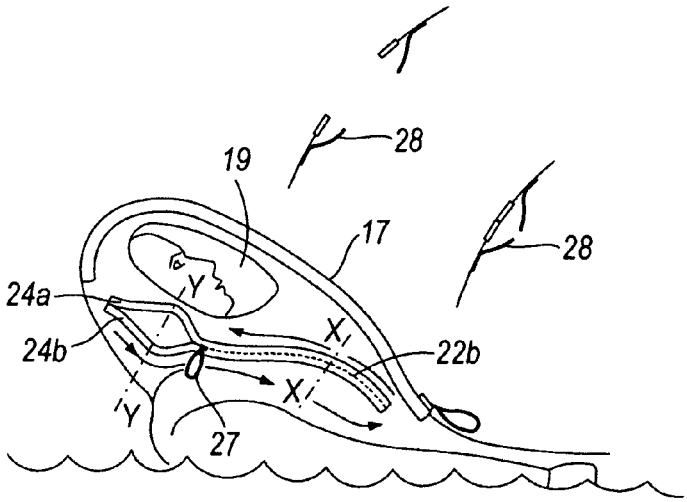

FIG. 1 is a front elevation of a submarine escape suit including a hood having a face portion connected to the remainder of the hood by two releasable connections, FIG. 2 is a side elevation of the submarine escape suit of FIG. 1, FIG. 3 is a schematic view of part of one of the connections of the submarine escape suit of FIGS. 1 and 2 in an open condition and a slider assembly in a first position, FIG. 4 is a similar view to FIG. 3 but with the slider in a second position, FIG. 5 is a similar view to FIGS. 3 and FIG. 4 but with the slider moving along the connection to re-engage the connection, FIG. 6 is a side elevation of a person wearing the submarine escape suit of FIGS. 1 to 5 after ascent from the submarine to the surface of the sea and with the face portion of the hood closed and having a section on the line X-X, FIG. 7 is a similar view to FIG. 6 but with the face portion open, and FIG. 8 is a similar view to FIG. 6 but with the connections re-closed and showing sections along the lines X-X and Y-Y.

Referring first to FIGS. 1 and 2, the submarine escape suit is formed from waterproof material, such as a rubberised fabric, and includes left and right foot portions 10*a*, 10*b* for receiving the feet of a wearer, left and right leg portions 11*a*, 11*b* for receiving the legs of a wearer, a body portion 12 for receiving the torso of a wearer and, left and right arm portions 13*a*, 13*b* for receiving the arms of a wearer. These parts are conventional and will not be described in further detail.

The suit also includes a hood indicated generally at 14. The hood 14 has a domed portion 15 for covering the head of a wearer and is surrounded by a yoke 16 that extends across the shoulders of the wearer and down the front of the body portion 12 as seen in FIGS. 1 and 2. The yoke 16 is connected to the body portion 12 by a waterproof connection.

The hood 14 is provided with a medial opening 17 closed by a zip 18. This opening 17 allows the wearer to step in the suit when the suit is being donned. The hood 14 is also provided with two translucent panels 19 level with the face of a wearer to allow a wearer to see out of the suit.

As seen in FIGS. 1 and 2 in broken line, the submarine escape suit may also include a pack 20 containing an inflatable liferaft for use by the wearer when the wearer reaches the surface, in a manner to be described below.

The construction of the hood 14 will now be described in more detail.

The hood 14 includes a face panel 21 that incorporates the translucent panels 19 and the medial opening 17. The face panel 21 is connected to the hood 14 by left and right releasable connections 22*a*, 22*b*. Each releasable connection 22*a*, 22*b* extends from an edge 23 of the hood 14 on the chest of the body portion 12 to a respective side of the hood 14 around an associated translucent panel 19 to terminate at respective points on the domed portion 15.

Referring now to FIGS. 3, 4 and 5, each releasable portion 22*a*, 22*b* is formed by two rows of zipper teeth 24*a*, 24*b*. In the configuration of the hood 14 shown in FIGS. 1 and 2, the teeth 24*a*, 24*b* are separably engaged. An airtight sealing strip 28 (see FIGS. 6 and 8) is provided on the inner side of the engaged teeth 24*a*, 24*b*. At the end of the connection 22*a*, 22*b* at the domed portion 15, there is provided a slider assembly formed by an upper slider 25 and a lower slider 26. The function of this will be described below.

In use, the suit is donned by a person by within a submarine wishing to escape from the submarine. The wearer enters from the medial opening 17 using in the zip 18 and steps into the suit before re-zipping the zip 18 of the medial opening 17 so that the wearer is wearing the suit as shown in FIGS. 1 and 2. The wearer then enters an escape chamber of the submarine and plugs the suit into an air supply of the submarine via an air line (not shown). Air is transferred into the suit and, in particular, into the hood 14. At the same time, the escape chamber fills with water and, when filled, the hatch opens to allow the wearer to ascend to the surface, breathing, during ascent, the air in the hood 14. When the wearer reaches the surface, the air in the suit provides buoyancy that allows the wearer to float on his/her back on the surface as shown in FIG. 6. If a liferaft is provided, the liferaft can be inflated and deployed and the wearer sit in the liferaft.

If a wearer wishes to expose his/her face to fresh air, the wearer grabs the edge 23 and lifts the face panel 21 away from the remainder of the hood 14. This disengages the zipper teeth 24*a*, 24*b* of both releasable connections 22*a*, 22*b* and allows the face panel 21 to hinge about the points on the domed portion 15 at the end of the connections 22*a*, 22*b*. At the same time, the airtight sealing strip 28 is torn. This position is shown in FIG. 7.

It is possible that the wearer may wish to re-cover his/her face as a result, for example, of increasing spray or rain or even very strong sunshine. To do this, the face panel 21 is pivoted back down over the wearer's face. The upper sliders 25 on both sides of the face panel 21 are then pulled downwardly using loops 27 provided, in the direction indicated by the arrow 1 in FIG. 8. The upper sliders 25 push down the lower sliders 26 until the ends of the zipper teeth 24*a*, 24*b* are reached. At that point, the lower sliders 26 are prevented from moving further. The upper sliders 25 can then be drawn upwardly using the loops 27 to re-engage the teeth 24*a*, 24*b* in the direction of the arrow 2 in FIG. 8 to re-attach the face portion 21 to the remainder of the hood 14. The attachment may be complete or, as shown in FIG. 8, partial to provide ventilation to the hood 14 and prevent the build-up of carbon dioxide within the hood 14.

It will be appreciated there are a large number of alterations that can be made to the arrangement described above with reference to the drawings. The connections need not be made by using zipper teeth; they could be made by using any suitable connection. For example, the connections sold under the trade mark VELCRO may be used. There need not be two connections, there could be one connection. In addition, it is not necessary that the face panel 21 is re-attachable to the remainder of the hood 14. It might be desirable to have a face panel 21 that can only be disconnectable from the remainder of the hood 14. In this case, the face panel 21 may be removable completely from the remainder of the hood 14.

Where the face panel 21 is removable and re-attachable, these need not be by use of the same means. Separate means can be provided for the initial attachment and other means provided for re-connection.

The invention claimed is:

1. A submarine escape suit comprising a hood configured to cover the head of a wearer, the hood including a face panel configured to overly the face of a wearer, the face panel divided into first and second portions by a first releasable closure disposed in the face panel, the first releasable closure configured to allow a wearer to enter the submarine escape suit through the face panel when the first releasable closure is open, and the face panel being connected to the remainder of the hood by second and third releasable closures disposed on opposite sides of the face panel, the second and third releasable closures configured to enable the face panel to be lifted away from the remainder of the hood to expose the face of a wearer.

2. A submarine escape suit according to claim 1 wherein the submarine escape suit further comprises:

a yoke surrounding the hood; and a body portion to which the yoke is connected by a waterproof connection.

3. A submarine escape suit according to claim 2 wherein the first releasable connection is a zipper.

4. A submarine escape suit according to claim 2 wherein the second and third releasable closures each terminate, at respective ends thereof remote from a lower edge of the hood, at respective spaced points proximate a domed portion of the hood, the material of the hood between said spaced points forming a hinge about which the face panel hinges when the second and third releasable closures are released.

5. A submarine escape suit according to claim 1 wherein the face panel includes one or more translucent panels.

6. A submarine escape suit according to claim 1, wherein the releasable closures are watertight.

7. A submarine escape suit according to claim 1 wherein the face panel, after release, is re-attachable to the remainder of the hood.

8. A submarine escape suit according to claim 6 wherein the face panel, after release, is re-attachable to the remainder of the hood, and wherein said second and third releasable closures are re-attachable.

9. A submarine escape suit according to claim 1 wherein the releasable connections are each formed by two side-by-side rows of inter-engaging parts, the parts being releasable and re-engageable.

10. A submarine escape suit according to claim 9 wherein the inter-engaging parts are releasable by a wearer gripping the face portion and pulling the face panel away from the remainder of the hood.

11. A submarine escape suit according to claim 10 wherein the inter-engaging parts are two side-by-side rows of zipper teeth that are releasable on separation of the face panel from the remainder of the hood, a slider being provided acting between the rows of zipper teeth for re-engaging the teeth.

12. A submarine escape suit according to claim 11 wherein the slider is located initially at an end of the associated releasable closure remote from a lower edge of the hood, the slider being movable to said edge along the associated rows of teeth and movable back along the associated rows of teeth to engage the teeth.

13. A submarine escape suit according to claim 12 wherein the slider can, after engaging the teeth, be moved back towards said edge to provide an air vent.

14. A submarine escape suit according to claim 1 further comprising an airtight sealing strip on an inner side of each of the second and third releasable closures.

15. A submarine escape suit according to claim 14 wherein each air tight sealing strip is configured to be torn upon lifting of the face panel away from the remainder of the hood.

16. A submarine escape suit according to claim 5 wherein the one or more translucent panels comprises first and second translucent panels located on opposite respective sides of the first releasable closure.

17. A submarine escape suit according to claim 1 wherein the first releasable closure is configured to enable a wearer to enter the submarine escape suit when one or both of the second and third releasable closures are closed.

* * * * *

UNITED STATES PATENT AND TRADEMARK OFFICE

CERTIFICATE OF CORRECTION

PATENT NO. : 8,006,317 B2
APPLICATION NO. : 12/442370
DATED : August 30, 2011
INVENTOR(S) : Taylor et al.

It is certified that error appears in the above-identified patent and that said Letters Patent is hereby corrected as shown below:

Column 1
Line 43, change "which:–" to --which:--

Column 2
Line 40, change "by a person by within" to --by a person within--

Column 3
Line 33, change "overly" to --cover--

Signed and Sealed this
Third Day of January, 2012

David J. Kappos

David J. Kappos
*Director of the United States Patent and Trademark Office*